United States Patent [19]

Ikeura

[11] 4,061,117

[45] Dec. 6, 1977

[54] METHOD OF CONTROLLING AIR-FUEL MIXTURE IN INTERNAL COMBUSTION ENGINE AND A SYSTEM THEREFOR

[75] Inventor: Kenji Ikeura, Yokosuka, Japan

[73] Assignee: Nissan Motor Company, Ltd., Yokohama, Japan

[21] Appl. No.: 672,020

[22] Filed: Mar. 30, 1976

[30] Foreign Application Priority Data

Mar. 31, 1975 Japan ..... 50-38926
May 26, 1975 Japan ..... 50-62647

[51] Int. Cl.[2] ..... F02D 35/00; F02D 75/10

[52] U.S. Cl. ..... 123/119 EC; 123/32 EE; 123/41.31; 60/276; 204/195 S

[58] Field of Search ..... 60/276, 285; 123/32 EE, 123/41.31, 119 EC; 204/1 S, 195 S

[56] References Cited

U.S. PATENT DOCUMENTS

| | | | |
|---|---|---|---|
| 3,616,274 | 10/1971 | Eddy | 204/195 S |
| 3,768,259 | 10/1973 | Carnahan et al. | 60/285 |
| 3,841,987 | 10/1974 | Friese et al. | 204/195 S |
| 3,900,012 | 8/1975 | Wahl et al. | 123/32 EE |
| 3,909,385 | 9/1975 | Speilberg et al. | 204/195 S |
| 3,940,327 | 2/1976 | Wagner et al. | 204/195 S |
| 3,960,693 | 6/1976 | Weyl et al. | 204/195 S |

OTHER PUBLICATIONS

Felming et al., "Sensor for On-Vehicle Detection of Exhaust Gas Composition" May, 1973, by Society of Automotive Engineers Inc.

*Primary Examiner*—Wendell E. Burns

[57] ABSTRACT

In an internal combustion engine having a catalytic converter arranged in the exhaust system, a mixture control system is provided to control the air-to-fuel ratio of the mixture to be produced in the mixture supply system toward a predetermined level which is optimum for enabling the converter to operate to its capacity, wherein the control system includes an exhaust sensor which detects the concentration of a predetermined type of chemical component of the exhaust gases for monitoring the air-to-fuel ratio of the mixture delievered to the engine cylinders and which is located downstream of the branch portions of the exhaust manifold and upstream of the catalytic converter. The exhaust sensor may be provided with cooling means to be in play when the engine is operating under full-power conditions.

11 Claims, 8 Drawing Figures

METHOD OF CONTROLLING AIR-FUEL MIXTURE IN INTERNAL COMBUSTION ENGINE AND A SYSTEM THEREFOR

The present invention relates in general to internal combustion engines of automotive vehicles and specifically to a gasoline-powered automotive internal combustion engine of the type using a catalytic converter in the exhaust system for exhaust cleaning purposes. More specifically, the present invention is concerned with a method of controlling the air-to-fuel ratio of the combustible mixture to be produced in the mixture supply system of the internal combustion engine of the particular type and with a mixture control system adapted to put the method into practice in an internal combustion engine of the specified type.

Some modernized automotive vehicles are equipped with catalytic converters in the exhaust systems of the engines for converting the toxic air contaminants in the exhaust emissions into harmless compounds. A typical example of the known catalytic converters uses an oxidative catalyst which is especially effective to re-combust the unburned combustible compounds such as hydrocarbons (HC) and carbon monoxide (CO) contained in the exhaust gases emitted from the engine cylinders. The oxidative catalyst is not only reactive to these combustible compounds but is operable to reduce nitric oxides ($NO_x$) in the exhaust gases if the exhaust gases to be processed by the catalyst have a chemical composition within a certain range which is dictated by the air-to-fuel ratio of the mixture supplied to the engine cylinders. Thus, the catalytic converter using the oxidative catalyst provides triple effects to process the most important three kinds of air contaminative compounds in the exhaust gases when the air-to-fuel mixture supplied to the engine cylinders is proportioned to an air-to-fuel ratio within a certain range. Experiments have revealed that it is the stoichiometric air-to-fuel ratio of about 14.8:1 (for a gasoline powered engine) that enables the triple effect or "three-way" catalytic converter to produce its maximum conversion efficiency against the three types of air contaminative compounds. It is, for this reason, desirable in an internal combustion engine using such a catalytic converter that the mixture supply system of the engine be arranged with mixture control means adapted to regulate the air-to-fuel ratio of the mixture toward the stoichiometric level or maintain the air-to-fuel ratio within a predetermined range containing the stoichiometric level.

If, however, the mixture control means used in combination with the triple-effect catalytic converter is of an "open-loop" type which operates without respect to the conditions of the exhaust emission of the engine, problems arise in accurately controlling the air-to-fuel ratio of the mixture because of the fluctuations in the operational and/or environmental variables of the engine such as for example the pressure and temperature of atmospheric air and the temperature of fuel to be fed into the mixture supply system. These variables are predominant over the desnity and viscosity of the fuel delivered into the mixture supply system and, as a consequence, the fluctuations in the variables cause the air-to-fuel ratio of the mixture to fluctuate over a wide range. The fluctuations in the air-to-fuel ratio of the mixture supplied to the engine cylinders result, in turn, in fluctuations in the concentrations of air contaminative compounds in the exhaust gases emitted from the cylinders. Insofar as the catalytic converter of the described type is used in combination with the mixture control means of the open-loop type, the potential capabilities of the catalytic converter could not be exploited satisfactorily. Extreme difficulties would be encountered if attempts were to be made to solve these problems merely by recourse to sophisticated design considerations tailored to the performance characteristics of individual engines.

To provide a solution to the problems arising from the use of the open-loop mixture control means operative irrespective of the varying conditions of the exhaust system, a "closed-loop" or "feedback" type mixture control system has been proposed which is adapted to control the air-to-fuel ratio of the mixture on the basis of information fed back from the exhaust system.

The closed-loop or feedback mixture control system involves an exhaust sensor operative to detect the concentration of a prescribed type of chemical component contained in the exhaust gases emitted from the engine cylinders and produce an analog electric signal, usually voltage, indicative of the detected concentration of the chemical component. The chemical composition of the exhaust gases is a faithful representation of the air-to-fuel ratio of the mixture delivered to the engine cylinders and, for this reason, the closed-loop or feedback mixture control system is capable of accurately monitoring the air-to-fuel ratio of the mixture produced in the mixture supply system of the engine and regulating the ratio toward the stoichiometric level irrespective of the fluctuations in the pressure and temperature of atmospheric air and the temperature of the fuel delivered into the mixture supply system of the engine. The chemical component of the exhaust gases to be detected may be oxygen, carbon monoxide, carbon dioxide, hydrocarbons or nitric oxides wherein oxygen in particular is the most preferred for ease of detection. The catalytic converter has been exemplified as being of a tripple-effect type but the closed-loop or feedback type mixture control system is useful also for an internal combustion engine arranged with a catalytic converter reactive to one or two of the above mentioned three types of air contaminative compounds if the mixture control system is designed to regulate the air-to-fuel ratio of the mixture toward a level optimum for the particular function of the converter or maintain the air-to-fuel ratio within a predetermined range containing the optimum level.

The performance efficiency of a catalytic converter is affected not only by the proportion between the air and fuel components in the air-fuel mixture supplied to the engine cylinders but by the temperature of the exhaust gases passed through the converter, as is well known in the art. If the temperature of the exhaust gases passed through a catalytic converter is lower than a predetermined level of, for example, about 400° C for a converter using an oxidative catalyst, the catalytic converter is unable to produce its maximum conversion efficiency even though the air-to-fuel ratio of the mixture supplied to the engine cylinders may be controlled appropriately for the converter. It is, for this reason, important that the catalytic converter provided in the exhaust system be located as close to the exhaust ports of the cylinders as possible and arranged with heat insulating means to minimize liberation of heat from the exhaust system upstream of the catalytic converter. On the other hand, the exhaust sensor to detect the chemical composition of the exhaust gases is usually so designed as to properly operate when the temperature of the exhaust gases contacting the sensor is within a predetermined range of, for example, from about 400° C to about 900° C for a sensor using a sintered electrolyte of zirconium oxide coated with microporous platinum layers. For the mere purpose of enabling the exhaust sensor to properly operate, the sensor may therefore be located anywhere in the exhaust system provided the temperature of the exhaust gases contacting the sensor falls within the predetermined range.

The analog signal produced by the exhaust sensor is fed to an electric control circuit and is compared with a fixed reference signal which may be representative of the air-to-fuel ratio optimum for the total performance characteristics of the catalytic converter. The air-to-fuel ratio of the mixture to be produced in the mixture supply system of the engine is regulated by electrically operated air and/or fuel flow control means controlled in accordance with the output signal delivered from the control circuit. The air-to-fuel ratio determined in this fashion on the basis of the signal produced by the exhaust sensor is monitored by the exhaust sensor which detects the concentration of a prescribed type of chemical component of the exhaust gases resulting from the air-fuel ratio thus controlled. A considerable time delay is therefore involved in feeding back information to the mixture supply system from the exhauses gases resulting from the mixture produced in the supply system. Such a time lag will become the longer as the exhaust sensor is located farther from the exhaust ports of the engine cylinders. The time lag deteriorates the performance accuracy of the mixture control system and accordingly the performance efficiency of the catalytic converter. From the view point of enabling the catalytic converter to produce its maximum conversion efficiency, therefore, it is desirable that the exhaust sensor be located as close to the exhaust ports of the engine cylinders as possible. If, however, the exhaust sensor is located either in one of the exhaust ports or at the upstream end of one of the branch portions of the exhaust manifold, then the information delivered from the exhaust sensor could not be a faithful representation of the air-to-fuel ratio of the mixture produced in the mixture supply system because the the mixture delivered from the mixture supply system is not always distributed uniformly to the individual cylinders and as a consequence the chemical components of the exhaust gases from one cylinder are not similarly proportioned to those of the exhaust gases from another cylinder in a usual multi-cylinder internal combustion engine. If the exhaust sensor is located downstream of the catalytic converter, the information produced by the sensor would also be unreliable because the sensor only detects the composition of the exhaust gases which have been processed by the catalytic converter.

The temperature of the exhaust gases varies markedly depending upon the operating conditions of the engine, peaking up when the engine is operating under full-power conditions. If, therefore, the location of the exhaust sensor in the exhaust system is selected in consideration of the temperature range of the exhaust gases under low-to-medium load operating conditions alone of the engine, the exhaust sensor may be subjected to a temperature higher than a predetermined range that will enable the sensor to operate properly. This will critically impair the total performances of the exhaust sensor and the catalytic converter and, furthermore, shorten the service life of not only the sensor due to an increased thermal load but the converter because of an increased amount of burden that will be imposed on the converter due to increased concentrations of air contaminative compounds to be processed by the converter.

As is well known in the art, the requirement for the control of vehicular exhaust emission is far more serious in urban areas where engines are usually operated under low-to-medium load conditions than in suburban areas which are less inhabited and in which engines are usually operated under high-power conditions producing extremely reduced quantities of noxious compounds in the exhaust gases. From this point of view, the purpose of controlling the exhaust emission can be practically accomplished by accurately controlling the air-to-fuel ratio of the mixture only when the engine is being operated under medium-to-low load conditions producing exhaust gases having a temperature lower than a certain limit.

When the temperature of the exhaust gases rises beyond such a level under high-power conditions of the engine, the exhaust sensor arranged in the exhaust system on the basis of the above described principle will be subjected to an increased thermal load that might cause the component parts of the exhaust sensor to fracture and disable the sensor from functioning.

The present invention contemplates solution of all these problems that have been encountered in an automotive internal combustion engine using a known closed-loop or feedback mixture control system combined in effect with a catalytic converter.

It is, accordingly, a prime object of the present invention to provide an improved method of controlling the air-to-fuel ratio of the mixture to be produced in the mixture supply system of an internal combustion engine of the type arranged with a catalytic converter in the exhaust system so that the catalytic converter is enabled to produce its maximum conversion efficiency against one or more types of air contaminative compounds contained in the exhaust gases from the engine cylinders.

It is another object of the present invention to provide a method of controlling the air-to-fuel ratio of the mixture to be produced in the mixture supply system of an internal combustion engine of the described type through accurate detection of the conditions of the exhaust gases especially under medium-to-low load operating conditions of the engine.

Yet, it is another prime object of the present invention to provide an improved mixture control system adapted to carry the method into practice in the internal combustion engine of the described type.

In accordance with one important aspect of the present invention, there is provided in an automotive internal combustion engine including a mixture supply system for producing from air and fuel delivered thereto an air-fuel mixture to be fed to the engine cylinders and an exhaust system having incorporated therein a catalytic converter which is reactive to at least one type of air contaminative compound in the exhaust gases passed therethrough and which exhibits its maximum conversion efficiency to the exhaust gases resulting from a mixture having a predetermined air-to-fuel ratio, a method of controlling the air-to-fuel ratio of the mixture to be produced in the mixture supply system comprising detecting the concentration of at least one type chemical component of the exhaust gases from the engine cylinders by means of an exhaust sensor located in the exhaust system downstream of the branch portions of the exhaust maniflod and upstream of the catalytic converter, producing a signal representative of the detected concentration of the aforesaid chemical component and regulating the delivery rate of at least one of air and fuel to the mixture supply system by means of the signal for thereby controlling the air-to-fuel ratio of the mixture produced in the mixture supply system toward the above mentioned predetermined air-to-fuel ratio. The exhaust sensor is preferably located in that portion of the exhaust system in which the temperature of the exhaust gases passed therethrough falls within a predetermined range under low-to-medium load operating conditions of the engine so that the control system can be accurately responsive to the conditions of the exhaust gases especially during low-to-medium load conditions of the engine. To protect the exhaust sensor from being subjected to excessive thermal load resulting from a rise of temperature under high-power conditions of the engine, the method according to the present invention may further comprise detecting high-load operating conditions of the engine and subjecting the exhaust sensor to a forced flow of cooling medium externally of the exhaust system under the high-load operating conditions of the engine.

In accordance with another important aspect of the present invention, there is provided a mixture control system for an automotive internal combustion engine including a mixture supply system for producing from air and fuel delivered thereto an air-fuel mixture to be fed to the engine cylinders and an exhaust system having incorporated therein a catalytic converter which is reactive to at least one type of air contaminative compound in the exhaust gases passed therethrough and which exhibits its maximum conversion efficiency to the exhaust gases resulting from a mixture having a predetermined air-to-fuel ratio, the control system comprising electrically operated valve means for regulating the delivery rate of at least one of air and fuel to the mixture supply system, an exhaust sensor arranged in the exhaust system for detecting the concentration of at least one type of chemical component of the exhaust gases emitted from the engine cylinders for producing an electrical signal representative of the detected concentration, the exhaust sensor being located downstream of the branch portions of the exhaust maniflod and upstream of the catalytic converter in the exhaust system, and an electric control circuit for controlling the valve means by the signal from the exhaust sensor so that the delivery rate of at least one of air and fuel to the mixture supply system is regulated to control the air-to-fuel ratio of the mixture to be produced in the mixture supply system toward the above mentioned predetermined air-to-fuel ratio. In the control system thus arranged, the exhaust sensor is located preferably in that portion of the exhaust system in which the temperature of the exhaust gases passed therethrough falls within a predetermined range under low-to-medium load operating conditions of the engine as previously mentioned. To protect the exhaust sensor from an excessive thermal load, the control system may further comprise passageway means communicating with a source of cooling medium and having a chamber portion enclosing a portion of the exhaust sensor projecting externally of the exhaust system, flow inducing means for establishing a forced flow of the cooling medium through the chamber portion of the passageway means and control means responsive to high-power conditions of the engine for actuating the flow inducing means to establish the flow of the cooling medium in the chamber portion under high-power conditions of the engine.

The features and advantages of the method and control system according to the present invention will become more apparent from the following description taken in conjunction with the accompanying drawings in which like reference numerals designate similar units, members and elements and in which.

Figure 1:
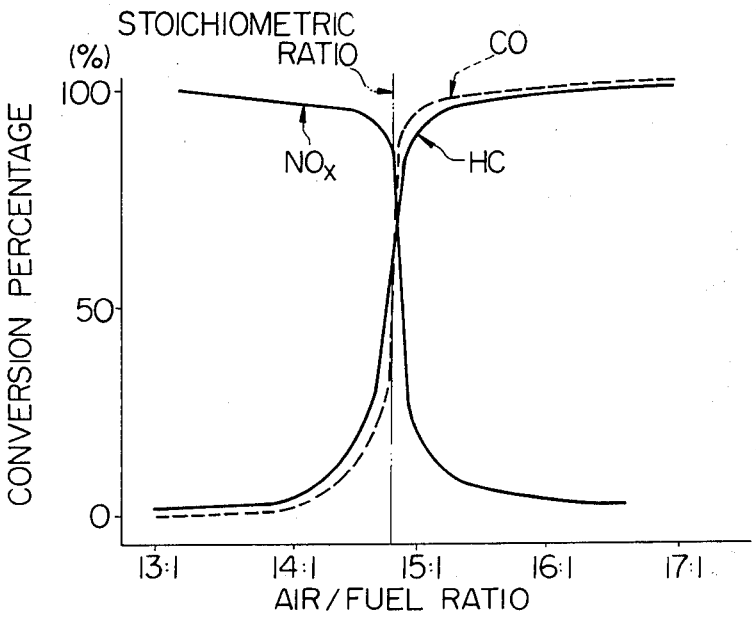
FIG. 1 is a graph which shows curves indicating representative examples of the variation in the conversion percentages with respect to air-to-fuel ratio as achieved by a triple-effect catalytic converter reactive to three typical types of air contaminative compounds in exhaust gases from an automotive internal combustion engine.

Reference will now be made to the drawings, first to FIG. 1 which shows curves indicating typical examples of the variation of the percentages of conversion of hydrocarbons (HC), carbon monoxide (CO) and nitric oxides ($NO_x$) in exhaust gases from an automotive gasoline-powered internal combustion engine as achieved by a tripple-effect catalytic converter when the air-to-fuel ratio of the mixture supplied to the engine cylinders is varied in the neighbourhood of the stoichiometric ratio of about 14.8:1. The percentage of conversion herein referred to is the percentage of the quantity by weight of the hydrocarbons, carbon monoxide or nitric oxides converted into harmless compounds (such as water and carbon dioxide from hydrocarbons or carbon monoxide) by a triple-effect catalytic converter versus the quantity by weight of each of these air contaminative compounds contained in the exhaust gases to be passed through the catalytic converter. From the curves shown, it is evident that the conversion percentages of hydrocarbons and carbon monoxide increase abruptly and the conversion percentage of nitric oxides drop abruptly when the air-to-fuel ratio of the mixture supplied to engine cylinders is increased beyond the stoichiometric ratio of about 14.8:1 and vice versa. The air-to-fuel ratio of the mixture providing the best compromise between the acceptable ranges of the conversion percentages of the three types of air contaminative compounds is, therefore, approximately 14.8:1, viz., in the vicinity of the stoichiometric ratio.

If, thus, the air-to-fuel ratio of the mixture supplied to engine cylinders is controlled in such a manner as to constantly approximate the stoichiometric ratio in a gasoline-powered internal combustion engine arranged with a triple-effect catalytic converter in the exhaust system, the catalytic converter will be enabled to exhibit its maximum total performance efficiency in processing the above mentioned three types of air contaminative compounds in the exhaust gases passed through the converter. If it is desired to achieve higher conversion percentages of particularly for hydrocarbons and carbon monoxide which are contained in higher concentrations in the exhaust gases emitted under medium-to-high load operating conditions of the engine, then the air-to-fuel ratio may be controlled to be slightly higher than 14.8:1 so as to make the mixture leaner than the stoichiometric mixure. If, conversely, it is desired to have nitric oxides processed more efficiently than hydrocarbons and carbon monoxide with a view to further reducing the concentration of the nitric oxides which are contained in an increased concentration under full-power conditions of the engine, then the air-to-fuel ratio may be controlled to be slightly lower than 14.8:1 to make the mixture richer than the stoichiometric mixture.

Figure 2:
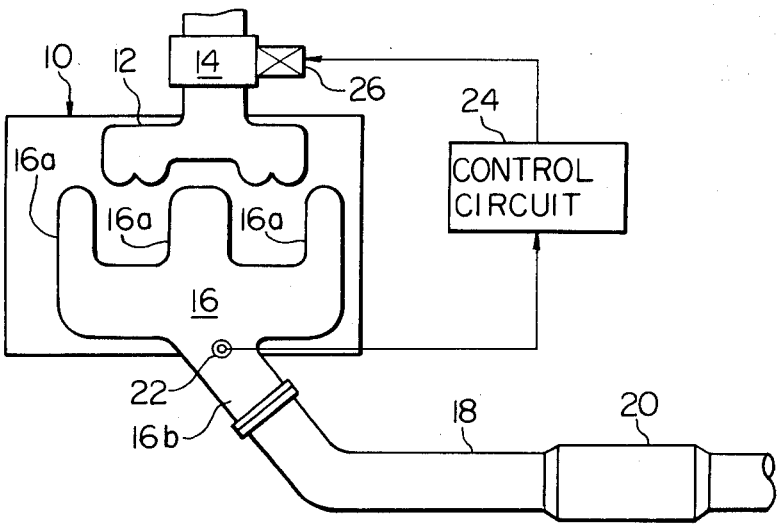
FIG. 2 is a schematic view showing an internal combustion engine incorporating a preferred embodiment of the mixture control system according to the present invention.

FIG. 2 illustrates an internal combustion engine provided with a closed-loop or feedback mixture control system arranged to realize the above described basic principle in controlling the air-to-fuel ratio on the basis of the information fed back from the exhaust system equipped with a catalytic converter.

Referring to FIG. 2, an internal combustion engine is shown to be of a multi-cylinder type having a cylinder block 10 formed with a plurality of engine cylinders (not shown). Though not shown, these cylinders communicate across respective intake valves with engine intake ports which are formed in the cylinder head as is customary in the art. The intake ports are, in turn, jointly in communication with an intake manifold 12 connected to an air-fuel mixture supply system 14 which may be a carburetor or of a fuel-injection type. The mixture supply system 14 is provided with air and fuel delivery means through which air and fuel are delivered to the mixture supply system 14 so that a mixture of air and fuel is produced in the system with an air-to-fuel ratio which is dictated by the ratio between the rates at which air and fuel are delivered into the system, as well known. The engine cylinders in the cylinder block 10 are, furthermore, in communication across respective exhaust valves with engine exhaust ports which are usually formed in the cylinder head. The exhaust ports are, in turn, jointly in communication with an exhaust manifold 16 having branch portions **16*a* respectively communicating upstream with the exhaust ports and a "plenum" tube portion 16*b* into which the individual branch portions 16*a* coverage. The exhaust ports and the exhaust manifold 16 form part of the exhaust system which further comprises an exhaust pipe 18 leading from the downstream end of the plenum tube portion 16*b* of the exhaust manifold 16. The exhaust pipe 18**, in turn, leads through a muffler or mufflers to a tail pipe which is open to the atmosphere at its terminal end, though not shown.

Figure 3:
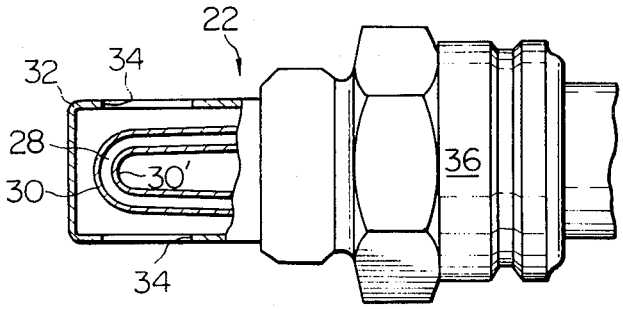
FIG. 3 is a partially cut-away external view of an example of an exhaust sensor employed in the mixture control system of the engine illustrated in FIG. 2.

The exhaust system is arranged with a catalytic converter 20 which is shown located in the exhaust pipe 18 but which may be located in the plenum tube portion **16*b* of the exhaust manifold 16 if desired. The catalytic converter 20 is assumed, by way of example, to be of the previously described triple-effect type which is capable of processing hydrocarbons, carbon monoxide and nitric oxides in the exhaust gases passed therethrough. As previously discussed, the catalytic converter of this type exhibits its maximum total conversion efficiency in processing the three kinds of air contaminative compounds particularly when the air-fuel mixture supplied to the engine cylinders is proportioned to a stoichiometric ratio or to a ratio which is variable within a certain narrow range containing the stoichiometric ratio. To achieve this end, the air delivery means or the fuel delivery means or both of air and fuel delivery means of the mixture control system 14 are operated under the control of a mixture control system which comprises an exhaust sensor 22, an electric control circuit 24 and a solenoid-operated valve unit 26. The exhaust sensor 22 is provided in the exhaust system and detects the concentration of a predetermined type of chemical component of the exhaust gases emitted from the engine cylinders. For the purpose of description, the exhaust sensor 22 is assumed to be of the type which is adapted to detect the concentration of oxygen in the exhaust gases. FIG. 3 illustrates the construction of a representative example of the exhaust sensor 22** of this type.

Referring to FIG. 3, the exhaust sensor 22 comprises a tubular electrolytic element 28 of, for example, sintered zirconium oxide coated with outer and inner layers 30 and 30' of microporous platinum. The electrolytic element 28 having the platinum layers 30 and 30' is enclosed within a casing 32 formed with a plurality of openings 34. The casing 32 is connected to or integral with a socket 36 by which the exhaust sensor 22 is mounted on a predetermined wall portion of the exhaust system so that the casing 32 projects into a passageway portion of the exhaust system. The outer platinum layer 30 is thus exposed to the exhaust gases admitted into the casing 32 through the openings 34, while the inner platinum layer 30' is exposed to atmospheric air through a passageway (not shown) formed in the socket 36. The solid electrolytic element 28 is oxygen ion conductive at a temperature within a certain range of, for example, between 400° C and 900° C and produces between the outer and inner platinum layers 30 and 30' a voltage that varies with the difference between the partial pressures of oxygen to which the outer and inner platinum layers 30 and 30' are exposed, viz., between the concentration of oxygen in the exhaust gases and the concentration of oxygen in atmospheric air. The concentration of oxygen in the exhaust gases varies substantially in relationship to the air-to-fuel ratio of the mixture combusted in the engine cylinders and, for this reason, the voltage developed between the outer and inner platinum layers 30 and 30' varies with the air-to-fuel ratio fed to the engine cylinders. A typical example of the relationship between the air-to-fuel ratio and the resultant voltage thus produced by the exhaust sensor 22 is indicated by the curve shown in FIG. 4. As will be seen from FIG. 4, the voltage produced by the exhaust sensor 22 is highly dependent on the air-to-fuel ratio and changes abruptly or substantially stepwise between the order of 20 milli-volts and the order of 1000 milli-volts when the air-to-fuel ratio of the mixture is in the vicinity of the stoichiometric level fo about 14.8:1, reaching approximately 400 milli-volts at the stoichiometric air-to-fuel ratio. Though not shown in FIG. 3, the two platinum layers 30 and 30' are provided with respective contact terminals so that the voltage produced between the platinum layers is delivered from the exhaust sensor 22 to the previously mentioned electric control circuit 24 (FIG. 2). The exhaust sensor 22 has been assumed to be of the type responsive to the oxygen component of the exhaust gases but, if desired, may be of any other type responsive to, for example, hydrocarbons, carbon monoxide, carbon dioxide or nitrogen oxides in the exhaust gases.

Figure 4:
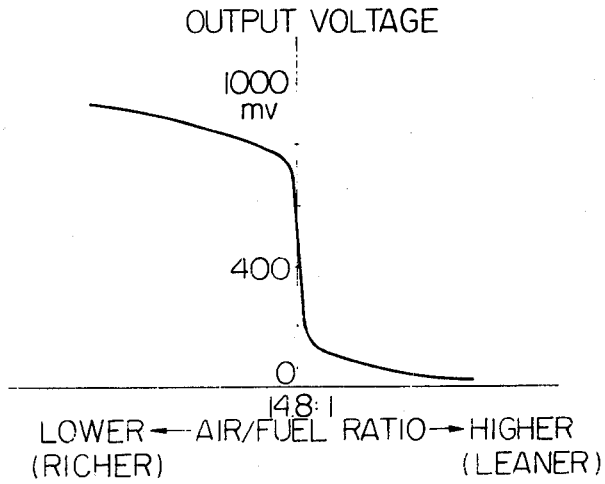
FIG. 4 is a graph which shows a curve indicating an example of the waveform of an output signal produced by the exhaust sensor illustrated in FIG. 3 with respect to air-to-fuel ratio.
Figure 5:
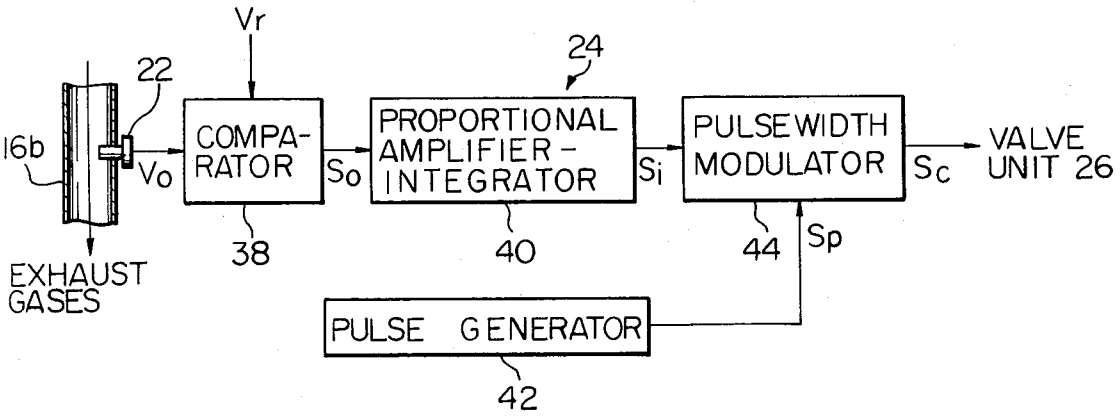
FIG. 5 is a block diagram showing a preferred example of an electric control circuit which may be employed in a mixture control system embodying the present invention.

FIG. 5 illustrates an example of the electrical arrangement of the control circuit 24 connected to the exhaust sensor 22 of the nature above described. The control circuit 24 comprises a comparator 38, a combination proportional amplifier and integrator 40, a saw-tooth or triangular wave generator 42 and a pulsewidth modulator 44. The comparator 38 has an input terminal connected to the output terminal of the above mentioned exhaust sensor 22 and is supplied therefrom a signal voltage $Vo$ that varies with the air-to-fuel ratio as indicated by the curve shown in FIG. 4. The comparator 38 has another input terminal through which a constant reference voltage $Vr$ is impressed on the comparator 38. The reference voltage $Vr$ is herein assumed to be set at 400 milli-volts which is produced when the air-to-fuel ratio is on the stoichiometric level of about 14.8:1 as above noted with reference to FIG. 4. The comparator 38 is operative to compare the signal voltage $Vo$ from the exhaust sensor 22 with the reference voltage $Vr$ and delivers a binary output signal $So$ which assumes a logic "0" value when the former is higher than the latter (viz., when the air-fuel mixture fed to the engine cylinders is richer than the stoichiometric mixture) and a logic "1" value when the former is lower than the latter (viz., when the mixture fed to the engine cylinders is leaner than the stoichiometric mixture). The binary signal $So$ is supplied to the combination proportional amplifier and integrator 40 which is arranged to produce a linear ramp signal $Si$ that increases or decreases in response to the input signal $So$ of the logic "0" or "1" value, respectively. The saw-tooth or triangular wave generator 42 is operative to produce a train of saw-tooth or triangular pulses $Sp$ having equal pulsewidths and a predetermined frequency. The ramp signal $Si$ from the combination proportional amplifier and integrator 40 and the train of saw-tooth or triangular pulses $Sp$ from the pulse generator 42 are fed to the pulse modulator 44. The pulse modulator 44 is, in effect, a comparator which is operative to compare the ramp signal $Si$ with the saw-tooth or triangular pulses $Sp$ and produce a train of square-shaped pulses having positive durations when the pulses $Sp$ are higher in magnitude than the ramp signal $Si$. The square-shaped pulses are delivered from the pulse modulator 44 as the output signal $Sc$ of the control circuit 24 to be solenoid-operated valve unit 26.

Turning back to FIG. 2, the solenoid-operated valve unit 26 is assumed to be of a two-position type which is actuated to open and close by the signal pulses $Sc$ from the control circuit 24 and regulates the rate or rates at which air and/or fuel are to be delivered into the mixture supply system 14 in such a manner as to control the air-to-fuel ratio of the mixture produced in the mixture supply system toward the stoichiometric ratio of about 14.8:1. The closed-loop or feedback mixture control system thus controls the air-to-fuel ratio of the mixture to be supplied to the engine on the basis of the analog signal fed back from the exhaust system to the mixture supply system for enabling the catalytic converter 20 to produce its maximum total conversion efficiency.

The performance characterisitics of the closed-loop or feed-back mixture control system used in combination with the catalytic converter of the described character are, thus, definitely dictated by the performance of the exhaust sensor 22 producing a basic signal on the basis of which the control system is to operate. If, therefore, the exhaust sensor 22 fails to reliably monitor the air-to-fuel ratio of the mixture due to the time leg involved in feeding back the information from the exhaust system to the mixture control system or to the rise of the temperature of the exhaust gases beyond a predetermined range enabling the sensor to properly operate as previously discussed, then the mixture control system is disabled from accurately controlling the air-to-fuel ratio of the mixture in the mixture supply system 14 and will disable the catalytic converter 20 from achieving its maximum total conversion efficiency especially under low-to-medium load operating conditions of the engine. When the engine is being operated under full-power, high-load conditions, the mixture supplied to the engine cylinders is combusted substantially completely so that the exhaust gases emitted from the cylinders contain reduced quantities of unburned combustible residues of hydrocarbons and carbon monoxide. Under the full-power, high-load operating conditions of the engine, therefore, the air-to-fuel ratio of the mixture to be produced in the mixture supply system 14 need not be controlled so accurately as during low-to-medium load operating conditions of the engine. All these suggest that the mixture control system will be enable to reliably function if the exhaust sensor 22 is located in such a portion of the exhaust system that is as close to the engine cylinders as possible and that is to pass therethrough exhaust gases having a temperature within a predetermined range that will enable the exhaust sensor to properly operate under low-to-medium load operating conditions of the engine.

If the exhaust sensor 22 is located in the exhaust port of one of the engine cylinders or in one of the branch portions 16*a* of the exhaust manifold 16 so as to minimize the time lag in feeding back the information from the exhaust system to the mixture supply system, then the information delivered from the exhaust sensor could not be faithfully representative of the air-to-fuel ratio of the mixture produced in the mixture supply system because the mixture is not always distributed uniformly to the individual cylinders and because the chemical components of the exhaust gases emitted from one cylinder are not strictly similarly proportioned to those of the exhaust gases from another cylinder. If, then, the exhaust sensor 22 is located downstream of the catalytic converter 20, the information delivered from the exhaust sensor would also be unreliable because of the fact that such information is representative of no less than the conditions of the exhaust gases that have been cleaned by the catalytic converter 20 and is therefore not a faithful representation of the air-to-fuel ratio of the mixture produced in the mixture supply system.

For these reasons, the present invention proposes to have the exhaust sensor 22 located in the exhaust system downstream of the branch portions 16*a* of the exhaust manifold 16 and upstream of the catalytic converter 20 which may be located in either the exhaust pipe 18 as shown or the plenum tube portion 16*b* of the exhaust manifold 16. The exhaust sensor 22 being assumed to be of the type using the electrolytic element of sintered zirconium dioxide, it is preferably that the exhaust sensor 22 be arranged in that portion of the exhaust system which not only falls within the above specified range of the exhaust system but will be subjected to the temperature of exhaust gases within the range of between about 400° C and 900° C under low-to-medium load operating conditions of the engine. If the exhaust sensor 22 of the described character is replaced with an exhaust sensor using an oxygen sensitive element of zirconium oxide containing calcium oxide as a stabilizer, the exhaust sensor may be located in that portion of the exhaust system which will be subjected to the temperature of a predetermined range lower than about 1600° C or, preferably, about 900° C and higher than about 400° C under low-to-medium load operating conditions of the engine.

During low-to-medium load operating conditions of the engine, the temperature of the exhaust gases being passed through the above mentioned portion of the exhaust system downstream of the branch portions **16*a* of the exhaust manifold 16 and upstream of the catalytic converter 20 is usually maintained within the range of from about 400° C to about 900° C so that the exhaust sensor 22 is enabled to produce an output voltage that will vary with the air-to-fuel ratio of the mixture as indicated by the curve shown in FIG. 4. The air-to-fuel ratio of the mixture produced in the mixture supply system 14 is therefore controlled accurately on the basis of the signal voltage $V_o$ produced by the exhaust sensor 22 and enables the catalytic converter 20 to function to its capacity. When, however, the engine is being operated under full-power, high-load conditions, the temperature of the exhaust gases in the above mentioned portion of the exhaust system will rise beyond 900° C and would disable the exhaust sensor 22 to produce a signal voltage closely dependent on the concentration of the oxygen component of the exhaust gases to which the sensor 22 is exposed. Under these conditions, however, the mixture fed to the engine cylinders is combusted substantially completely so that the exhaust gases delivered from the cylinders contain practically no unburned combustible compounds of hydrocarbons and carbon monoxide although considerable quantities of nitric oxides may be contained in the exhaust gases. Because, however, the catalytic converter 20 is relieved from the burden to process hydrocarbons and carbon monoxide that are contained in practically negligible concentration in the exhaust gases, the nitric oxides in the exhaust gases can be converted into harmless compounds at a satisfactorily high efficiency by the catalytic converter 20**.

Figure 6:
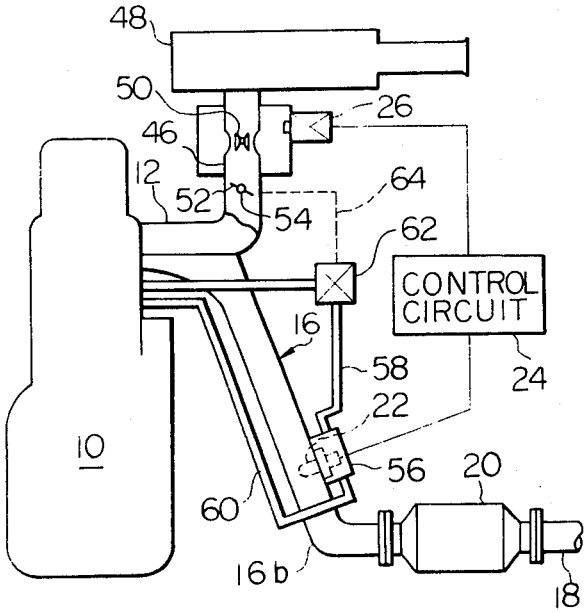
FIG. 6 is a schematic view showing an internal combustion engine incorporating another preferred embodiment of the mixture control system according to the present invention.

The exhaust gases can thus be sufficiently cleaned under full-power or high-load operating conditions of the engine although the air-to-fuel ratio of the mixture supplied to the engine cylinders could not be accurately controlled due to an increase in the exhaust temperature. The increased exhaust temperature is, however, causative of deterioration of the performance characteristics of the exhaust sensor 22 when the sensor is placed on use for a prolonged period of time and will, in the result, shorten the sevice life of the sensor. If, furthermore, the exhaust sensor 22 happens to be subjected to an extremely high exhaust temperature, the electrolytic element of the sensor may be disabled from functioning any longer. To prevent this from occurring, it is desirable that the exhaust sensor 22 arranged in the exhaust system in the above described fashion be provided with cooling means adapted to positively cool the exhaust sensor 22 during full-power or high-load operating conditions of the engine. FIG. 6 shows an arrangement in which an internal combustion engine is provided with such means.

Referring to FIG. 6, the internal combustion engine is assumed to be of the type using a carburetor as the mixture supply system 14. The carburetor has a mixture delivery pipe 46 which intervenes between an air cleaner 48 and the intake manifold 12. The mixture delivery pipe 46 is formed with a venturi 50 and has a throttle valve 52 located downstream of the venturi 50 as is customary. The throttle valve 52 is rotatable with a shaft 54 on the mixture delivery pipe 46 between fully-open and fully-closed positions through part-throttle position as is well known. The exhaust sensor 22 forming part of the mixture control system is shown provided in the plenum tube portion **16*b* of the exhaust manifold 16 with the catalytic converter 20 located in the exhaust pipe 18 similarly to the arrangement illustrated in FIG. 2**.

Figure 7:
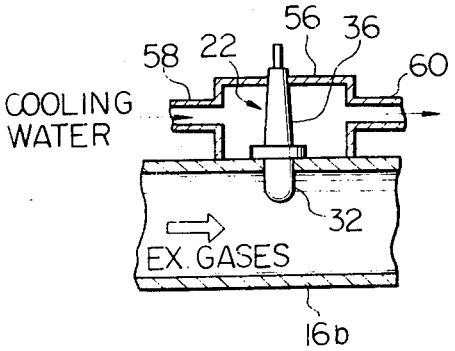
FIG. 7 is a fragmentary sectional view showing part of a preferred example of an exhaust sensor cooling arrangement incorporated in the mixture control system illustrated in FIG. 6.
Figure 8:
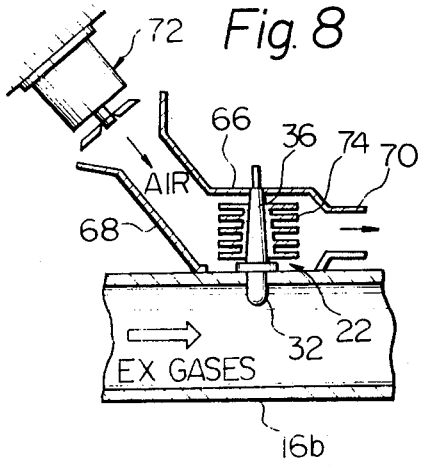
FIG. 8 is a view similar to FIG. 7 but shows part of another preferred example of the exhaust sensor cooling arrangement which may be used in a mixture control system embodying the present invention.

As will be seen more clearly from FIG. 7, the exhaust sensor 22 is mounted on the plenum tube portion **16*b* of the exhaust manifold 16 in such a manner that the previously mentioned casing 32 thereof projects into the passageway in the plenum tube portion 16*b* with the socket 36 projecting externally of the tube portion 16*b*. The socket 36 is at least in part enclosed within a cooling chamber 56 which is fixedly mounted on the external wall of the plenum tube portion 16*b* of the exhaust manifold 16. The cooling chamber 56 intervenes between passageways 58 and 60 bypassing the circuit (not shown) of the cooling water for the engine across a flow control valve 62 in the passageway 58. The passageways 58 and 60 are assumed to be the water feed and discharge passageways, respectively, for the cooling chamber 56 so that, when the flow control valve 62 is open, the cooling water from the engine cooling circuit is circulated through the water feed passageway 58 into the cooling chamber 56 and is returned from the cooling chamber 56 to the engine cooling circuit through the water discharge passageway 60. The flow control valve 62 is shown to be provided in the water feed passageway 58 but, if desired, the same may be provided in the water discharge passageway 60. The valve 62 is provided with suitable control means adapted to actuate the valve to open in response to full-power or high-load operating conditions of the engine such as for example the fully-open condition of the carburetor throttle valve 52 through a mehcanical linkage 64 connected to the shaft 54 of the throttle valve 52 as indicated by a broken line in FIG. 6. If desired, the control means for the valve 62 may be arranged in such a manner that the rate of flow of cooling water through the passageway 58 is continuously varied in proportion to the opening of the carburetor throttle valve 52. As an alternative to the angular position of the carburetor throttle valve 52, the vacuum developed in the intake manifold 12, the output speed of the engine or the temperature of the exhaust gases may be used as the parameter on the basis of which the flow control valve 62 is to operate. As an alternative, furthermore, of the engine cooling water, atmospheric air may be used as the cooling medium for the exhaust sensor 22 as illustrated in FIG. 8. In the arrangement of FIG. 8, the socket 36 of the exhaust sensor 22 is at least in part enclosed within a cooling chamber 66 intervening between air inlet and outlet passageways 68 and 70 which are open at their respective ends. A motor-driven fan 72 is positioned at or in the neighbourhood of the open end of the air inlet passageway 68 for inducing a draft of air into the passageway 68 so that the exhaust sensor 22 is forcibly cooled by the air being passed through the cooling chamber 66. The motor (not shown) to drive the fan 72 is energized in response to full-power or high-load operating conditions of the engine through detection of such conditions from the angular position of the carburetor, the vacuum in the intake manifold, the output speed of the engine or the temperature of the exhaust gases similarly to the flow control valve used in the cooling arrangement shown in FIGS. 6 and 7. If desired, the socket 36 of the exhaust sensor 22 thus cooled by atmospheric air may be provided with radiator fins 74 so that the heat in the exhaust sensor 22** is transferred to cooling air at an increased efficiency. As an alternative to the draft of air induced by the fan, the ram resulting from the vehicle velocity may be passed onto an externally projecting portion of the exhaust sensor through suitable passageway means (not shown).

What is claimed is:

1. In an automotive internal combustion engine including a mixture supply system for producing from air and fuel delivered thereto an air-fuel mixture to be fed to the cylinders of the engine and an exhaust system having incorporated therein a catalytic converter which is reactive to at least one predetermined type of air contaminative compound in the exhaust gases emitted from the engine cylinders and which exhibits its maximum conversion efficiency to the exhaust gases resulting from an air-fuel mixture having a predetermined air-to-fuel ratio, a method of controlling the air-to-fuel ratio of the mixture to be produced in the mixture supply system, comprising detecting the concentration of at least one predetermined type of chemical component of the exhaust gases from the engine cylinders by means of an exhaust sensor 1ocated in the exhaust system downstream of the branch tube portions of the exhaust manifold of the exhaust system and upstream of the catalytic converter, said exhaust sensor having an external portion projecting outwardly from the exhaust system, producing a signal representative of the detected concentration of said chemical component, controlling the delivery rate of at least one of air and fuel to the mixture supply system in accordance with said signal for regulating the air-to-fuel ratio of the mixture in the mixture supply system toward said predetermined air-to-fuel ratio, detecting high-load operating conditions of the engine, and inducing a forced flow of cooling fluid through said external portion of the exhaust sensor under high-load operating conditions of the engine.

2. A method as set forth in claim 1, in which exhaust sensor is located in that portion of the exhaust system in which the exhaust gases passed therethrough have a temperature within a predetermined range under low-to-medium load operating conditions of the engine.

3. A method as set forth in claim 2, in which said predetermined range of the exhaust temperature is from about 400° C to about 900° C.

4. A method as set forth in claim 1, in which said cooling fluid is engine cooling water circulated from the engine cooling water circuit.

5. A method as set forth in claim 1, in which said cooling fluid is atmospheric air.

6. A mixture control system for an automotive internal combustion engine including a mixture supply system for producing from air and fuel delivered thereto an air-fuel mixture to be fed to the cylinders of the engine and an exhaust system having incorporated therein a catalytic converter which is reactive to at least one predetermined type of air contaminative compound in the exhaust gases emitted from the engine cylinders and which exhibits its maximum conversion efficiency to the exhaust gases resulting from an air-fuel mixture having a predetermined air-to-fuel ratio, comprising electrically operated valve means for regulating the delivery rate of at least one of air and fuel to the mixture supply system, an exhaust sensor disposed in the exhaust system for detecting. the concentration of at least one predetermined type of chemical component of the exhaust gases from the engine cylinders and producing a signal representative of the detected concentration of said chemical component, the exhaust sensor being located downstream of the branch portions of the exhaust manifold of the exhaust and upstream of said catalytic converter and having an external portion projecting outwardly from the exhaust system, an electric control circuit for controlling said valve means in accordance with said signal so that the delivery rate of at least one of air and fuel to said mixture supply system is controlled to regulate the air-to-fuel ratio of the mixture in the mixture supply system toward said predetermined air-to-fuel ratio, passageway means communicating with a source of cooling fluid and having a chamber portion enclosing said external portion of said exhaust sensor, flow inducing means for inducing a forced flow of said cooling fluid through said chamber portion, and control means responsive to high-load operating conditions of the engine and operative to actuate said flow inducing means for establishing said forced flow of said cooling fluid through said chamber portion under high-load operating conditions of the engine.

7. A mixture control system as set forth in claim 6, in which said exhaust sensor is located in that portion of the exhaust system in which the exhaust gases being passed therethrough has a temperature within a predetermined range under low-to-medium load operating conditions of the engine.

8. A mixture control system as set forth in claim 7, in which said predetermined range of the exhaust temperature is from about 400° C to about 900° C.

9. A mixture control system as set forth in claim 6, in which said source of cooling fluid is the cooling water circuit of the engine.

10. A mixture control system as set forth in claim 6, in which said cooling fluid is atmospheric air.

11. A mixture control system as set forth in claim 10, in which said external exhaust sensor is provided with radiator fins surrounding said portion thereof.

* * * * *